United States Patent [19]

Gerkema et al.

[11] Patent Number: 4,644,577

[45] Date of Patent: Feb. 17, 1987

[54] X-RAY TUBE COMPRISING AN ANODE DISC ROTATABLY JOURNALLED ON A HELICAL-GROOVE BEARING

[75] Inventors: Jan Gerkema; Johannes L. M. Hagen; Johan A. Rietdijk, all of Eindhoven, Netherlands

[73] Assignee: U.S. Philips Corporation, New York, N.Y.

[21] Appl. No.: 689,888

[22] Filed: Jan. 9, 1985

[30] Foreign Application Priority Data

Jan. 10, 1984 [NL] Netherlands ..... 8400072

[51] Int. Cl.[4] ..... H01J 35/10

[52] U.S. Cl. ..... 378/133; 378/132

[58] Field of Search ..... 378/132, 133; 384/107, 384/112, 120, 292

[56] References Cited

U.S. PATENT DOCUMENTS 1,437,560 12/1922 Shearer ..... 384/292

2,381,513 8/1945 Pearson ..... 384/292

4,577,340 3/1986 Carlson et al. ..... 378/132

FOREIGN PATENT DOCUMENTS 0063394 10/1982 European Pat. Off. ..... 378/133

2038539 7/1980 United Kingdom ..... 378/133

*Primary Examiner*—Craig E. Church

*Assistant Examiner*—John C. Freeman

*Attorney, Agent, or Firm*—David R. Treacy

[57] ABSTRACT

An X-ray tube comprising a rotary anode which is journalled in a helical-groove bearing is constructed so that the axial median plane of the rotary anode system is approximately coincident with the axial center of the helical-groove bearing. The bearing block for the anode system is connected to the tube base preferably via a connection whose rigidity is adapted to the weight, the geometry and the weight distribution of the anode system. The connection allows for cooling of the bearing block by means of a cooling liquid.

9 Claims, 2 Drawing Figures

Figure 1:
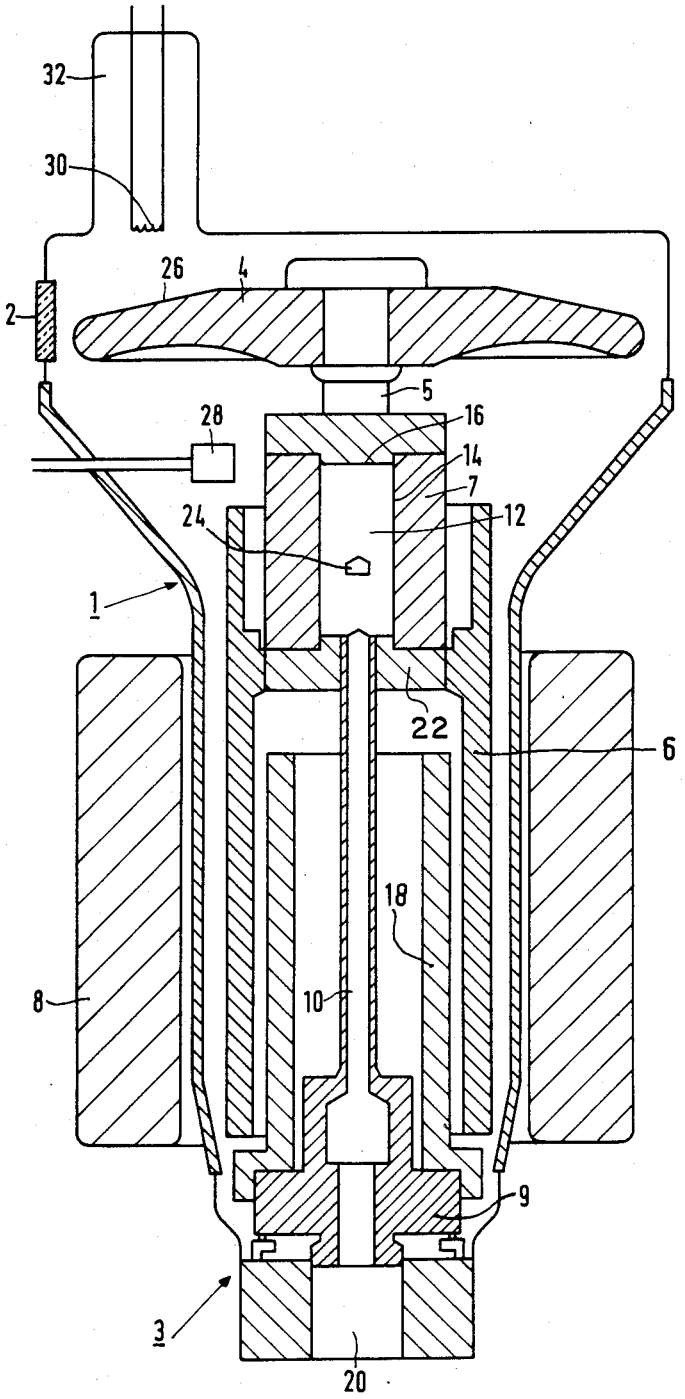

X-RAY TUBE COMPRISING AN ANODE DISC ROTATABLY JOURNALLED ON A HELICAL-GROOVE BEARING

The invention relates to an X-ray tube comprising an anode disc which is connected, via a rotary shaft, to a rotor which is journalled in a metal-lubricated helical-groove bearing.

An X-ray tube of this kind is known from U.S. Pat. No. 4,210,371. The rotor of the rotary anode system of the X-ray tube disclosed therein is journalled in a helical-groove bearing at both sides of the anode disc, viewed in the axial direction. Such journalling allows for precise positioning of the anode disc; however, it is difficult to achieve a precise mutual alignment of the two bearings which is also capable of withstanding, for example temperature variations. When the mutual alignment of the bearings is inadequate, twisting will occur upon rotation so that the precise positioning of the anode disc may be lost, thus affecting the service life of the tube.

It is the object of the invention to mitigate these drawbacks. To this end, an X-ray tube of the kind set forth in accordance with the invention is characterized in that the anode disc is journalled at one side only by means of a helical-groove bearing which is mounted about an axial median plane of the rotary anode system.

Because an X-ray tube in accordance with the invention is journalled at one side only, mutual alignment of bearings will no longer be required and hence there will be no twisting either. Because of the use of a helical-groove bearing which is situated about the median plane of rotation of the anode system, viewed in the axial direction, precise positioning of the anode disc and hence of an electron beam target to be formed thereon can still be maintained.

The helical-groove bearing of a preferred embodiment comprises a cylindrical bearing block which is mounted near the axial median plane and whose cylinder surface and preferably also at least one of its end faces is provided with helical grooves. Such a bearing is preferably lubricated by means of a metal lubricant which is already liquid at a comparatively low temperature, for example the Ga alloys mentioned in GB No. 2,010,985. In order to prevent attack by Ga, the bearing surfaces are then made of tungsten or molybdenum. When use is made of metal lubricants which become liquid only at somewhat higher temperatures, for example Bi In Pb alloys, i.e. without the comparatively aggressive Ga, the bearings may be made of stainless steel. Facilities are then provided in or around the tube in order to heat the bearing before activation.

A bearing block in a further preferred embodiment is connected, via a preferably hollow pipe having a rigidity which is adapted to the weight, the geometry and the weight distribution of the anode system in order to obtain stable rotation at the desired speeds of rotation, to a base portion of the tube which is preferably made of ceramic components. This pipe can be used for applying the high voltage to the anode disc and for circulating a cooling liquid through the bearing block.

The median plane of the anode system in a further preferred embodiment coincides substantially with the axial median plane of the anode disc as such. Extremely precise and stable positioning can thus be achieved even in the case of an asymmetrical weight distribution of the anode disc.

Figure 2:
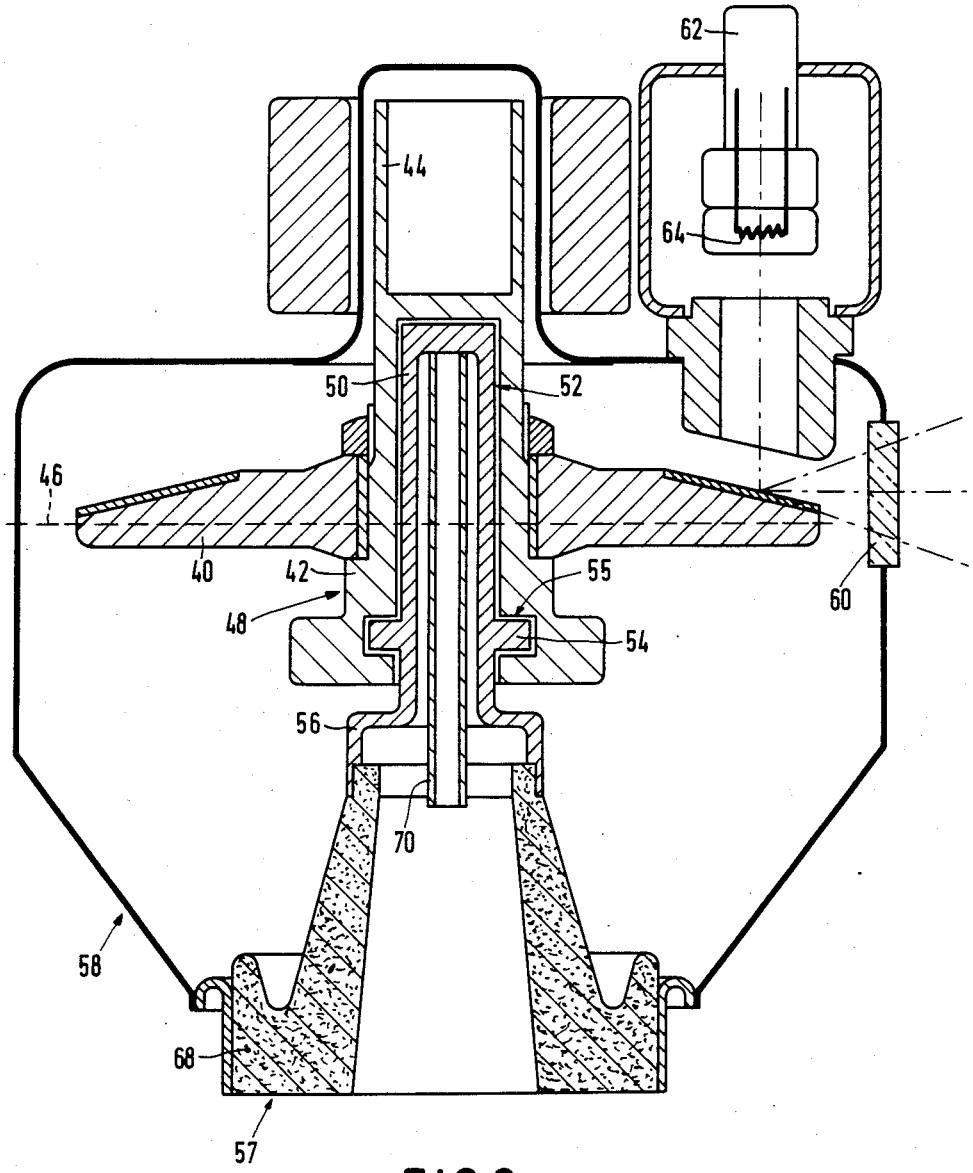

Some preferred embodiments in accordance with the invention will be described in detail hereinafter with reference to the drawing. Therein:

FIG. 1 shows an X-ray tube in accordance with the invention which comprises a bearing which is situated at one side of the anode disc, and FIG. 2 shows such an X-ray tube which comprises a bearing which is situated near the axial median plane of the anode disc as such.

An X-ray tube as shown in FIG. 1 comprises an anode disc 4 which is arranged in a housing 1 having a radiation window 2 and a base portion 3. The anode disc 4 is mounted on a rotary shaft 5 about which there is arranged a bearing sleeve 7 which is connected to a rotor 6. A stator 8 of a drive motor (not shown) for the anode disc 4 is coaxially arranged about the rotor 6. In the base portion 3 of the X-ray tube there is arranged a support 9 for a pipe 10 on which there is mounted a cylindrical bearing block 12 which fits in the bearing sleeve 7. A cylinder surface 14 and, for example, an end face 16 of the bearing block 12 are provided with helical grooves which form a helical-groove bearing. A suitable metal lubricant permits the bearing sleeve 7 to rotate about the bearing block 12. Also mounted on the support 9 is a bush 18 which is made of a soft-magnetic material and which increases the efficiency of the drive motor and also acts as a heat shield. The support 9 is accessible for an electrical connection via a connector 20. When the base portion 3 is made of an electrically insulating material, at least at the area surrounding the connector 20 and the support 9, the anode disk 4 can be connected to any desirable potential via the pipe 10. It may be advantageous to connect the rotor 6 to the bearing sleeve 7 via an electrically insulating ring 22. The axial weight distribution of the anode disc 4, the bearing sleeve 7 and the rotor 6 is such that an axial median plane 24 of this anode rotary system coincides at least substantially with the axial center of the bearing block 12. Thus, precise, temperature-sensitive positioning of the anode disc 4 and hence of a target 26 is achieved.

When use is made of a lubricant containing Ga, the bearing sleeve 7 and the bearing block 12 should preferably be made of tungsten and/or molybdenum, that is to say at least the parts thereof which come into contact with the lubricant. When use is made of a lubricant without Ga, for example, stainless steel can be used for the bearing sleeve 7 and the bearing block 12, stainless steel being a material which is cheaper and easier to machine. Because metal lubricants without Ga normally are not liquid at room temperature, the bearing 12 will have to be heated prior to being activated. To this end, inside or outside the X-ray tube there may be provided a heat source 28 in the form of a heating coil, a heat radiator or a high-frequency radiator. The thermal radiation of a filament 30 of a cathode device 32 of the X-ray tube can also be used for this purpose in many cases.

FIG. 2 shows an X-ray tube in which the risk of instabilities is further reduced by means of an adapted construction of the rotary anode system and the rigidity of the anode pipe. An anode disc 40 with a bearing sleeve 42 and a rotor 44 are constructed so that an axial median plane 46 of the assembly is substantially coincident with the axial median plane of the anode disc 40 as such. In accordance with the invention, the plane 46 coincides approximately with the axial center of a bearing 48 with the bearing sleeve 42 and a bearing block 50.

A cylinder surface 52 of the bearing block 50 is again provided with helical grooves and exhibits an annular widened portion 54 whose end faces 55 are also provided with helical grooves. Precise axial positioning can be obtained by means of this bearing 48. A connection 56 between the bearing block 50 and a base portion 57 has a comparatively heavy construction, so that the rigidity of the suspension of the anode system is increased and the risk of instabilities is further reduced when the further construction is also adapted.

The anode system is accommodated in a housing 58 which comprises a radiation exit window 60, a cathode device 62 with a filament 64 and the base portion 57 which again comprises, for example, a ceramic connector 68. The anode disc 40 can again be maintained at any desired potential via a metal hollow pipe 70. The hollow pipe 70 and an internal space of the bearing block 50 are very suitable for the passage of a cooling liquid. Such cooling is effective notably for this type of X-ray tube, because a comparatively large amount of heat can be dissipated from the anode disc 40 via the metal-lubricated helical-groove bearings. Use is again made of a metal lubricant, with or without Ga, in conjunction with the already described adaptations.

What is claimed is:

1. In an X-ray tube comprising (a) a rotary anode system comprising an anode disc, a rotary shaft, the anode disc being mounted on the shaft, a bearing sleeve arranged about the rotary shaft, and a rotor connected to the bearing sleeve; and (b) a metal-lubricated helical-groove bearing;

the improvement wherein the rotary anode system is journalled at one side only by means of the helical-groove bearing so that the axial weight distribution on the axial median plane of the rotary anode system coincides substantially with the axial center of the helical-groove bearing.

2. An X-ray tube as claimed in claim 1, characterized in that the bearing is formed by a cylindrical bearing block which is provided with a pattern of helical grooves on its cylindrical surface and on both of its end faces, said grooves cooperating in a bearing fashion with helical grooves provided in a bearing sleeve which supports the anode disc.

3. An X-ray tube as claimed in claim 2, characterized in that connecting means having a rigidity adapted to the anode system connects the bearing block to a base portion which is remote from the anode disc.

4. An X-ray tube as claimed in claim 1, characterized in that the axial median plane of the rotary anode system is situated at least substantially halfway between two end faces of the bearing.

5. An X-ray tube as claimed in claim 4, characterized in that said connecting means consists of a conducting pipe, and further comprising voltage means for applying a voltage potential to the anode disc via the conducting pipe and the bearing.

6. An X-ray tube as claimed in any one of preceding claims 1, 2, 3, 4 or 5 characterized in that wall portions of the helical-groove bearing which are provided with helical grooves are made of Mo or W, the helical-groove bearing being lubricated by means of Ga or a Ga alloy.

7. An X-ray tube as claimed in any one of the claims 1, 2, 3, 4 or 5, characterized in that the bearing sleeve and the bearing block are made substantially of steel, and the bearing being heatable from the outside.

8. An X-ray tube as claimed in claim 7, characterized in that the lubricant for the bearing consists of a metal alloy selected from the group consisting of Bi, In, and Pb.

9. An X-ray tube as claimed in any one of claims 1, 2, 3, 4, 5 or 8, characterized in that at least a portion of the bearing block which faces the base portion of the tube is provided with a passage for a cooling liquid.

* * * * *